US008373645B2

(12) United States Patent
Song et al.

(10) Patent No.: US 8,373,645 B2
(45) Date of Patent: Feb. 12, 2013

(54) METHOD OF DRIVING LIGHT SOURCES, LIGHT SOURCE DRIVING DEVICE FOR PERFORMING THE METHOD AND DISPLAY APPARATUS HAVING THE CIRCUIT

(75) Inventors: Hee-Kwang Song, Anyang-si (KR); Gi-Cherl Kim, Yongin-si (KR); Dong-Min Yeo, Daegu (KR); Sang-Il Park, Seoul (KR); Yong-Hoon Kwon, Asan-si (KR)

(73) Assignee: Samsung Display Co., Ltd (KR)

( * ) Notice: Subject to any disclaimer, the term of this patent is extended or adjusted under 35 U.S.C. 154(b) by 888 days.

(21) Appl. No.: 12/499,699

(22) Filed: Jul. 8, 2009

(65) Prior Publication Data

US 2010/0007670 A1 Jan. 14, 2010

(30) Foreign Application Priority Data

Jul. 11, 2008 (KR) ..... 10-2008-0067327

(51) Int. Cl.
*G09G 3/36* (2006.01)

(52) U.S. Cl. ..... 345/102

(58) Field of Classification Search ..... 345/87–102, 345/204, 690, 698–699
See application file for complete search history.

(56) References Cited

U.S. PATENT DOCUMENTS

| | | | | |
|---|---|---|---|---|
| 6,894,706 | B1 * | 5/2005 | Ward et al. | 345/660 |
| 8,009,182 | B2 * | 8/2011 | Shibahara | 345/699 |
| 2004/0046772 | A1 * | 3/2004 | Ouchi et al. | 345/690 |
| 2006/0007111 | A1 * | 1/2006 | Moon et al. | 345/102 |
| 2006/0077202 | A1 * | 4/2006 | Takeda | 345/213 |
| 2006/0126083 | A1 * | 6/2006 | Kurumisawa et al. | 358/1.2 |
| 2006/0164379 | A1 * | 7/2006 | Oh et al. | 345/102 |
| 2008/0055220 | A1 * | 3/2008 | Azuma et al. | 345/89 |
| 2008/0143757 | A1 * | 6/2008 | Furihata et al. | 345/690 |
| 2008/0180414 | A1 * | 7/2008 | Fung et al. | 345/204 |

FOREIGN PATENT DOCUMENTS

| | | |
|---|---|---|
| JP | 2007-322944 | 12/2007 |
| KR | 10-2005-0120596 | 6/2006 |
| KR | 10-2006-0007955 | 7/2007 |
| KR | 10-2006-0077763 | 2/2008 |

OTHER PUBLICATIONS

English Abstract for Publication No. KR 10-2006-0077763.
English Abstract for Publication No. KR 10-2005-0120596.
English Abstract for Publication No. KR 10-2006-0007955.
English Abstract for Publication No. JP-2007-322944.

* cited by examiner

*Primary Examiner* — Hong Zhou
(74) *Attorney, Agent, or Firm* — Innovation Counsel LLP

(57) ABSTRACT

A light source driving device includes a resolution analyzing part, a dimming block adjusting part, a local dimming part and a light source unit. The resolution analyzing part obtains an image resolution. The dimming block adjusting part adjusts the size or the number of dimming blocks generating light in a local dimming method in response to the resolution. The local dimming part generates a local dimming signal for individually driving the dimming blocks in response to the image data and the size or the number of dimming blocks. The light source unit is driven by the local dimming signal to generate light. The size or the number of the dimming blocks is adjusted to be optimized for the obtained image resolution, so that regardless of the image resolution, a local dimming signal corresponding to the size and the number of the dimming blocks may be generated.

19 Claims, 8 Drawing Sheets

METHOD OF DRIVING LIGHT SOURCES, LIGHT SOURCE DRIVING DEVICE FOR PERFORMING THE METHOD AND DISPLAY APPARATUS HAVING THE CIRCUIT

PRIORITY STATEMENT

This application claims priority under 35 U.S.C. §119 to Korean Patent Application No. 2008-67327, filed on Jul. 11, 2008 in the Korean Intellectual Property Office (KIPO), the content of which is herein incorporated by reference in its entirety.

BACKGROUND OF THE INVENTION

1. Field of the Invention

The invention relates to a method of driving light sources, a light source driving device for performing the method, and a display apparatus having the light source driving device. More particularly, the invention relates to a method of driving light sources by generating a local dimming signal for individually driving a plurality of dimming blocks, a light source driving device for performing the method, and a display apparatus having the light source driving device.

2. Description of the Related Art

In general, a liquid crystal display (LCD) device displays an image using a liquid crystal that has optical characteristics such as anisotropy of refractivity and electrical characteristics such as anisotropy of dielectric constant. LCD devices have various advantages such as thinner thickness, lower driving voltage, lower power consumption, etc., compared to other display devices such as cathode ray tube (CRT) devices and plasma display panel (PDP) devices. Therefore, LCD devices are used in laptop computers, monitors, television receiver sets, mobile phones, etc. LCD devices display image using optical and electrical properties of liquid crystal molecules, such as anisotropic refractive index and anisotropic dielectric constant. LCD devices include an LCD panel displaying an image using optical transmittance of liquid crystal molecules and a backlight assembly providing light to the LCD panel.

An LCD panel includes a first substrate having a plurality of pixel electrodes arranged in a matrix shape, a second substrate opposite to the first substrate with common electrode formed thereon, and a liquid crystal layer interposed between the first substrate and the second substrate.

A backlight assembly employs a plurality of cathode fluorescent lamps (CCFLs) as light sources. Recently, a plurality of light-emitting diodes (LEDs) having low power consumption and high color reproducibility has been employed as the backlight assembly.

A backlight assembly may generate light by individually driving dimming blocks arranged in a matrix shape to increase contrast ratio and to decrease power consumption. In such a device, the backlight assembly includes a dimming logic element for individually controlling the LEDs in each dimming blocks.

Generally, the size and the number of the dimming blocks may be determined according to the resolution of the LCD panel; the dimming logic element individually controls the dimming blocks according to the size or the number of the dimming blocks that is optimized to the resolution of the LCD panel.

However, when the resolution of the LCD panel is altered for various models, the dimming logic element may be required to be replaced with another dimming logic element that is optimized to the altered resolution, increasing cost of production.

SUMMARY OF THE INVENTION

Example embodiments of the present invention provide a method of driving light sources which generates a local dimming signal regardless of the image resolution of the display device.

Example embodiments of the present invention also provide a light source driving device for performing the above-mentioned method.

Example embodiments of the present invention further also provide a display device having the above-mentioned light source driving device.

According to one aspect of the present invention, a method of driving light sources is provided. In the method, an image resolution is first obtained. The size or the number of dimming blocks generating light in a local dimming method is adjusted according to the image resolution. A local dimming signal for individually driving the dimming blocks is generated according to an image data and the size or the number of dimming blocks. A light source is driven according to the local dimming signal.

In an example embodiment of the present invention, the resolution may be obtained using an image control signal, and the image control signal may include a clock signal, a horizontal synchronizing signal, a vertical synchronizing signal and a data enable signal.

In an example embodiment of the present invention, in obtaining an image resolution, the number of the clock signals cycles may be counted while the data enable signal is at a high level to obtain a horizontal image resolution. The number of the horizontal synchronizing signal pulses between two vertical synchronizing signal pulses may be further counted to obtain a vertical image resolution.

In an example embodiment of the present invention, generating the image control signal and the image data may be further performed with the image resolution stored in a resolution memory. Here, the image resolution may be the pixel resolution of a display unit for displaying an image.

Alternatively, generating the image control signal and the image data may be further performed with the image resolution set by user.

According to another aspect of the present invention, a light source driving device includes a resolution analyzing part, a dimming block adjusting part, a local dimming part and a light source unit. The resolution analyzing part obtains an image resolution. The dimming block adjusting part adjusts the size or the number of dimming blocks generating light in a local dimming method according to the image resolution. The local dimming part generates a local dimming signal for individually driving the dimming blocks in response to the image data and the size or the number of dimming blocks. The light source unit is driven by the local dimming signal to generate light.

In an example embodiment of the present invention, the resolution may be obtained by using an image control signal, and the image control signal may include a clock signal, a horizontal synchronizing signal, a vertical synchronizing signal and a data enable signal.

In an example embodiment of the present invention, the resolution analyzing part may include a horizontal counter and a vertical counter. The horizontal counter may count the number of the clock signals, while the data enable signal is at a high level, to obtain a horizontal image resolution. The vertical counter may count the number of the horizontal synchronizing signal pulses during one frame to obtain a vertical image resolution.

In an example embodiment of the present invention, the light source driving device may further include a frame buffer for storing the image data and the image control signal while the image resolution is obtained to adjust the size or the number of the dimming blocks.

In an example embodiment of the present invention, the light source driving device may further include a signal interface part, a dimming signal output part and an image signal output part. The signal interface part may receive an image data and an image control signal from an external image board. The dimming signal output part may output the local dimming signal to the light source unit. The image signal output part may output the image data and the image control signal to a display unit for displaying an image.

In an example embodiment of the present invention, the image resolution may be the pixel resolution of a display unit. The light source driving device may further include a resolution memory storing information on the pixel resolution of the display unit. The signal interface part may transmit the pixel resolution of the display unit stored in the resolution memory to the image board.

According to still another aspect of the present invention, a display apparatus includes a display unit, a light source unit, and a local dimming driving part. The display unit includes a display panel for displaying an image and a panel driving part for driving the display panel. The light source unit includes a plurality of dimming blocks providing the display unit with light and a light source driving part individually controlling the dimming blocks. The local dimming driving part controls the panel driving part and the light source part in response to an image data and an image control signal that are supplied by an external device. The local dimming driving part includes a resolution analyzing part obtaining an image resolution by using the image control signal and a dimming block adjusting part adjusting the size or the number of dimming blocks generating light in a local dimming method in response to the image resolution.

In an example embodiment of the present invention, each of the dimming blocks may include at least one light-emitting diode.

In an example embodiment of the present invention, the image resolution may be the pixel resolution of the display panel. The local dimming driving part may further include a resolution memory storing information on the pixel resolution of the display panel.

In an example embodiment of the present invention, the local dimming driving part may further include a frame buffer for storing the image data and the image control signal while the image resolution is obtained to adjust the size or the number of the dimming blocks.

According to some example embodiments of the present invention, the image control signal applied from an image board is analyzed to obtain the image resolution, and then the size or the number of the dimming blocks is adjusted to be optimized for the obtained image resolution. Therefore regardless of the image resolution, a local dimming signal corresponding optimized for the size or the number of the dimming blocks may be generated. As a result, although the image resolution changes, the dimming logic element need not be replaced.

BRIEF DESCRIPTION OF THE DRAWINGS

The above and other features and advantages of the present invention will become more apparent by describing in detailed example embodiments with reference to the accompanying drawings, in which.

DETAILED DESCRIPTION OF THE INVENTION

Figure 1:
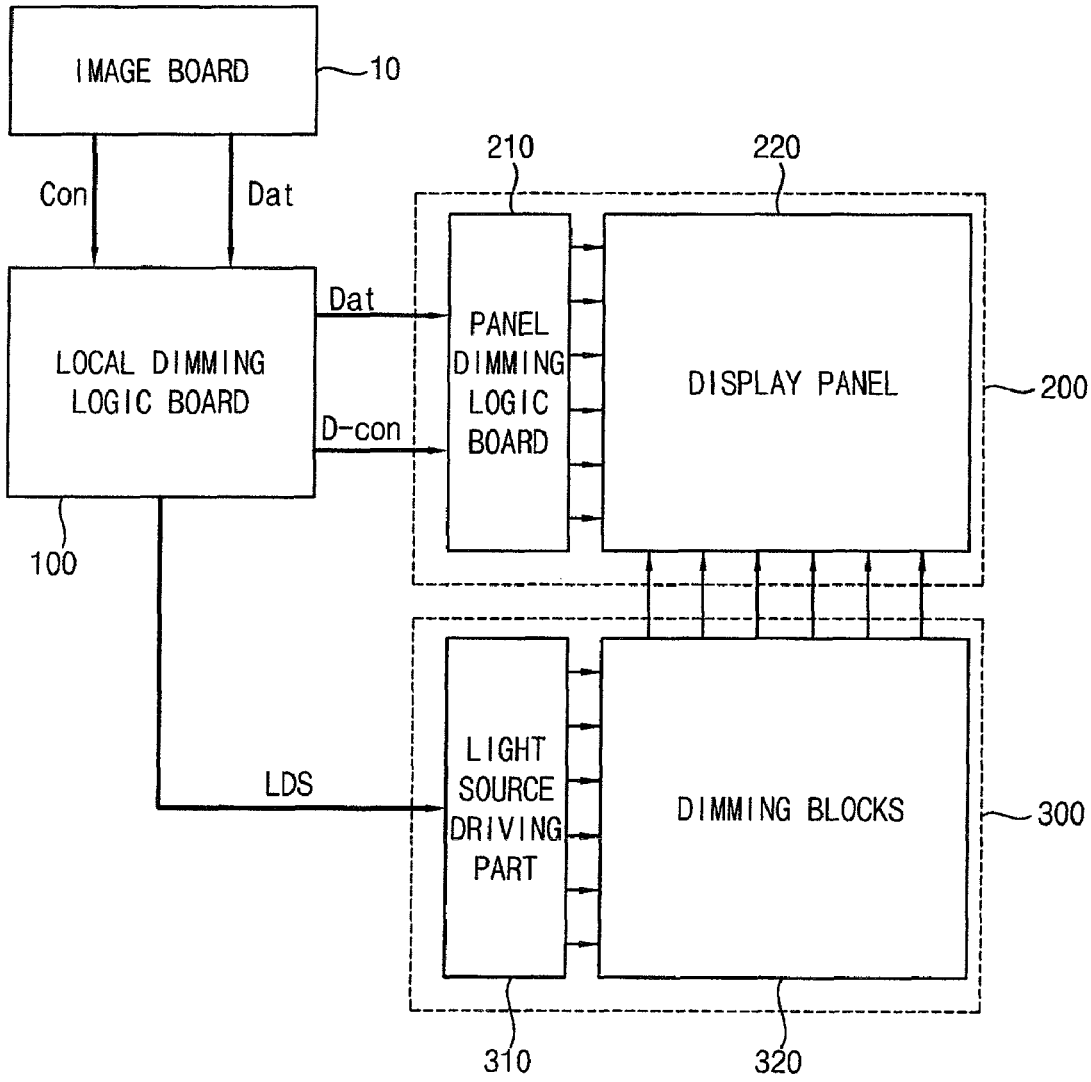
FIG. 1 is a block diagram schematically illustrating a display apparatus according to the first exemplary embodiment of the present invention.

The present invention is described more fully hereinafter with reference to the accompanying drawings, in which example embodiments of the present invention are shown. The present invention may, however, be embodied in many different forms and should not be construed as limited to the example embodiments set forth herein. Rather, these example embodiments are provided so that this disclosure will be thorough and complete, and will fully convey the scope of the present invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments of the invention are described herein with reference to cross-sectional illustrations that are schematic illustrations of idealized example embodiments (and intermediate structures) of the present invention. As such, variations from the shapes of the illustrations as a result, for example, of manufacturing techniques and/or tolerances, are to be expected. Thus, example embodiments of the present invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be explained in detail with reference to the accompanying drawings.

EXAMPLE EMBODIMENT 1

FIG. 1 is a block diagram schematically illustrating a display apparatus according to Embodiment 1 of the present invention.

Referring to FIG. 1, a display apparatus according to Embodiment 1 includes a local dimming logic board 100, a display unit 200 and a light source unit 300.

The local dimming logic board 100 receives an image signal including an image data Dat and an image control signal Con from an external image board 10. The local dimming logic board 100 outputs a driving image signal and a local dimming signal LDS in response to the image signal. Here, the driving image signal may be identical to the image signal or a transformed image signal. For example, the driving image signal may include the image data Dat and a driving control signal D-Con.

A detailed description for the local dimming logic board 100 will be explained with reference to additional drawings.

The display panel unit 200 includes a panel dimming logic board 210 and a display panel 220. The panel dimming logic board 210 outputs a panel driving signal to the display panel 220 in response to the driving image signal received from the local dimming logic board 100.

The display panel 220 may display an image by using light generated from the light source unit 300. For example, the display panel 220 may include a first substrate (not shown), a second substrate (not shown) opposite to the first substrate, and a liquid crystal layer (not shown) interposed between the first substrate and the second substrate.

The first substrate may include a plurality of signals, a plurality of thin-film transistors (TFTs) electrically connected to the signals, and a plurality of pixel electrodes electrically connected to the TFTs. The second substrate may include a plurality of color filters corresponding to the pixel electrodes and a common electrode formed on a whole surface of the second substrate. Here, the color filter is formed on the second substrate. Alternatively, the color filter may be formed instead on the first substrate.

The light source 300 includes a light source driving part 310 and a plurality of dimming blocks 320. The light driving part 310 outputs a plurality of light source driving signals to the dimming blocks 320 in response to the local dimming signal LDS received from the local dimming logic board 100. The dimming blocks 320 may be controlled by the light source driving signals with a local dimming method. That is, the dimming blocks 320 may be individually controlled by the light source driving signal to generate light.

Figure 2:
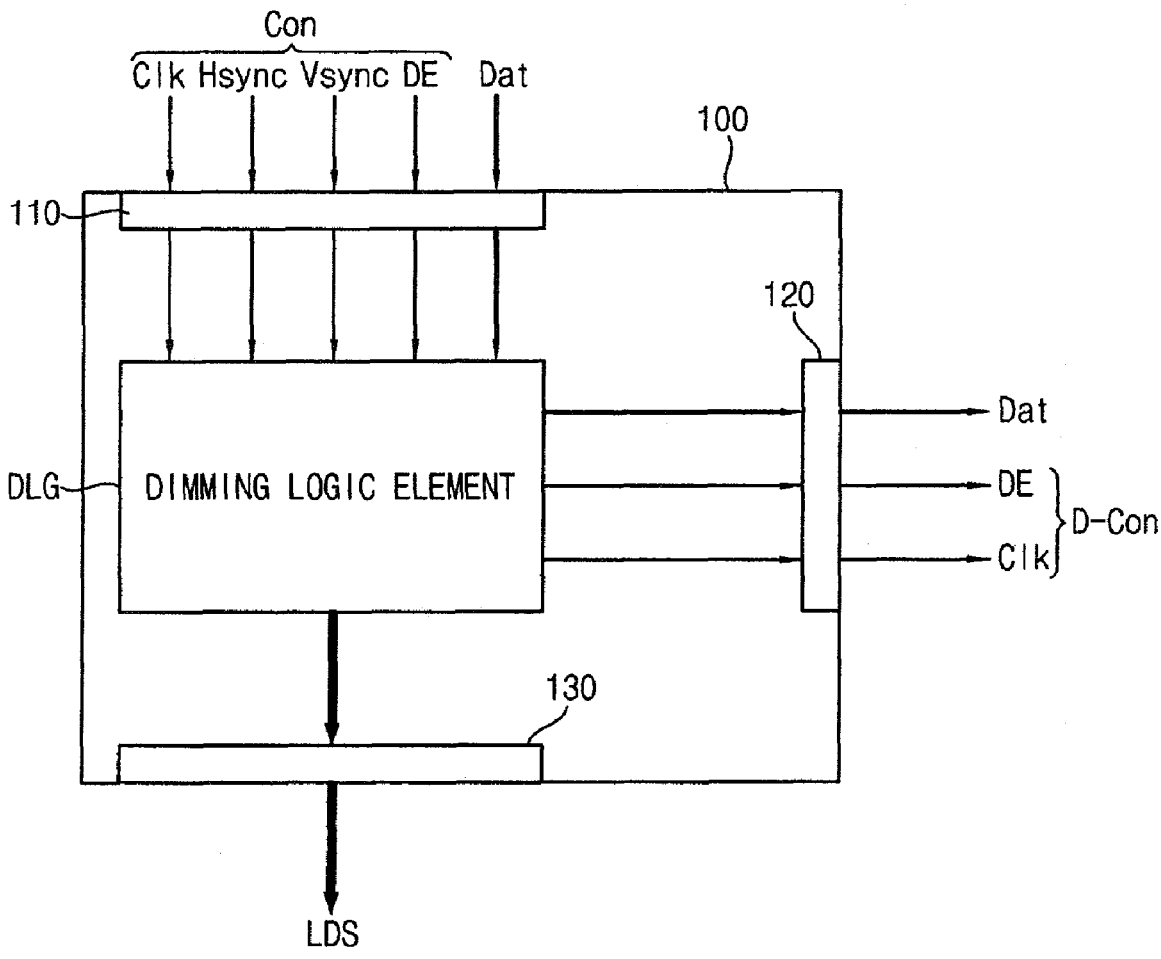
FIG. 2 is a block diagram illustrating a local dimming logic board of FIG. 1.

FIG. 2 is a block diagram illustrating a local dimming logic board of FIG. 1.

Referring to FIGS. 1 and 2, the local dimming logic board 100 includes a signal interface part 110, a dimming logic element DLG, an image signal output part 120 and a dimming signal output part 130.

The signal interface part 110 may receive the image signal including the image data Dat and the image control signal Con from the image board 10 to output the dimming logic element DLG. For example, the signal interface part 110 may change the image signal into a level that is used for the dimming logic element DLG, and may output the changed image signal to the dimming logic element DLG.

The image control signal Con may include a clock signal (Clk) for synchronizing the image data Dat, a horizontal synchronizing signal (Hsync) for indicating a start or end of one line of the image data Dat, a vertical synchronizing signal (Vsync) for indicating a start or end of one frame of the image data Dat, and a data enable signal (DE) for indicating a valid interval of the image data Dat. That is, the vertical synchronizing signal (Vsync) represents a time period used for displaying one frame, and the horizontal synchronizing signal (Hsync) represents a time period used for displaying one line of the frame. Thus, the interval between pulses of the horizontal synchronizing signal (Hsync) includes clock cycles corresponding to the number of pixels included in one line. The data enable signal (DE) represents the time during which the pixels are supplied with data.

The dimming logic element DLG receives the image signal from the signal interface part 110 to output the driving image signal and the local dimming signal LDS. Here, the driving image signal includes the image data Dat and the driving control signal D-Con, and the driving control signal D-con includes the clock signal Clk and the data enable signal DE. Although it is not shown in FIG. 2, the driving control signal D-Con may further include the horizontal synchronizing signal Hsync and the vertical synchronizing signal Vsync.

A detailed description for the local logic element DLG will be explained with reference to an additional drawing.

The image signal output part 120 receives the driving image signal from the dimming logic element DLG, and outputs the driving image signal to a panel dimming logic board 210 of the display unit 200. Here, the image signal output part 120 may change the driving image signal into a signal at a level that is suitable for the display panel, and may output the transformed driving image signal.

The dimming signal output part 130 receives the local dimming signal LDS from the dimming logic element DLG, and outputs the local dimming signal LDS to a light source driving part 310 of the light source unit 300. Here, the dimming signal output part 130 may change the local dimming signal LDS into a signal at a level that is suitable for the dimming block, and may output the transformed local dimming signal.

Figure 3:
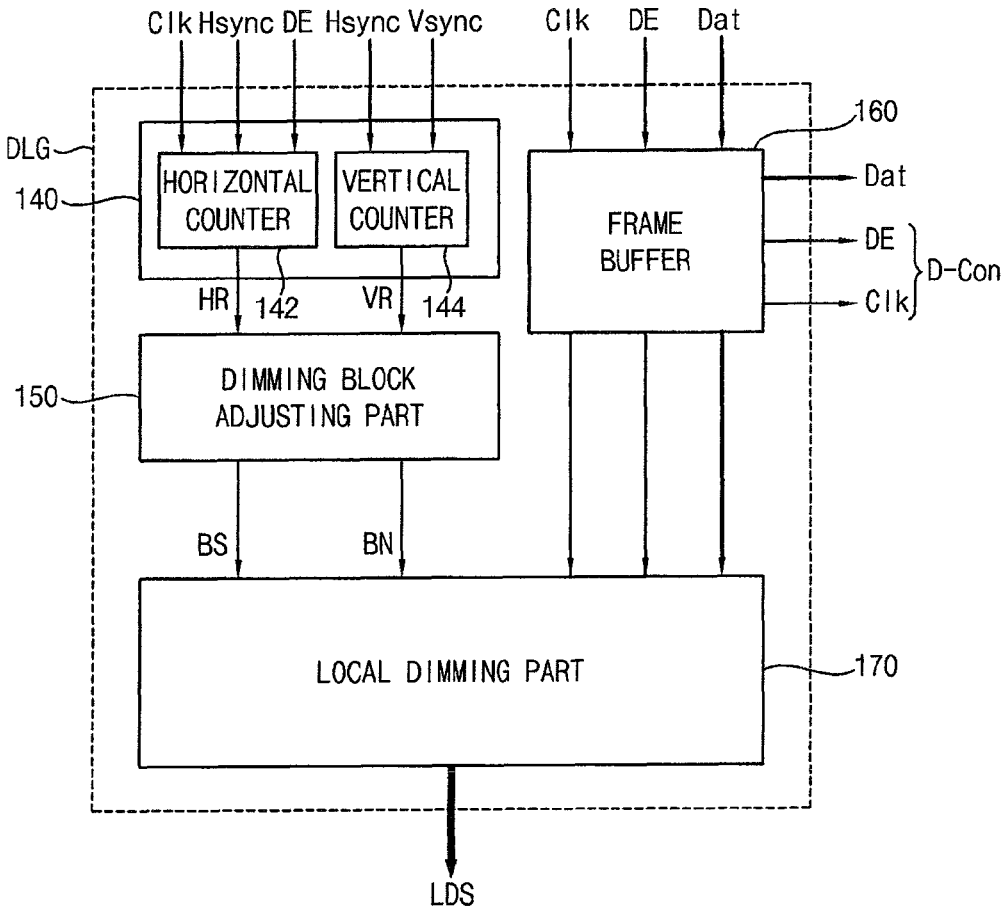
FIG. 3 is a block diagram illustrating a dimming logic element of FIG. 2.
Figure 4:
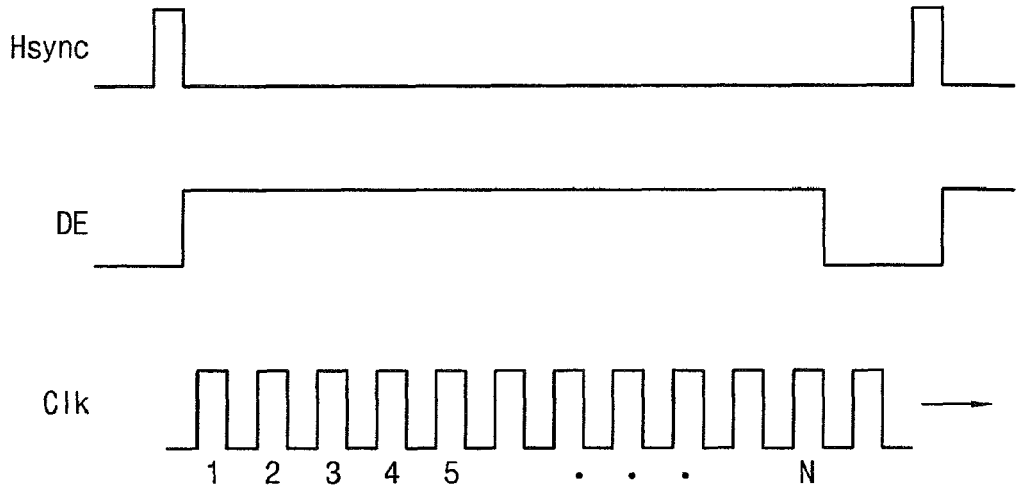
FIG. 4 shows wave diagrams illustrating a process of obtaining a horizontal resolution at the horizontal counter of FIG. 3.
Figure 5:
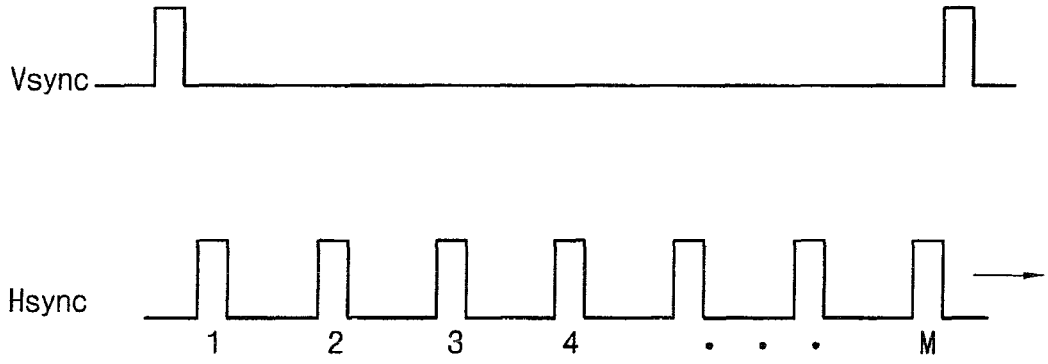
FIG. 5 shows wave diagrams illustrating a process of obtaining a horizontal resolution at the vertical counter of FIG. 4.

FIG. 3 is a block diagram illustrating a dimming logic element of FIG. 2. FIG. 4 depicts wave diagrams illustrating a process of obtaining a horizontal resolution at a horizontal counter 142 of FIG. 3. FIG. 5 shows wave diagrams illustrating a process of obtaining a horizontal resolution at a vertical counter 144 of FIG. 4.

Referring to FIGS. 2 and 3, the dimming logic element DLG includes a resolution analyzing part 140, a dimming block adjusting part 150, a frame buffer 160 and a local dimming part 170.

The resolution analyzing part 140 receives the image control signal Con from the signal interface part 110, and obtains an image resolution from the image control signal Con. For example, the resolution analyzing part 140 may include the horizontal counter 142 and the vertical counter 144. The horizontal counter 142 counts the number of the clock signals, while the data enable signal is at a high level, to obtain a horizontal image resolution. The vertical counter 144 counts the number of the horizontal synchronizing signal during one frame to obtain a vertical image resolution.

The horizontal counter 142 obtains the horizontal resolution HR of the image, by using the horizontal synchronizing signal Hsync, the data enable signal DE and the clock signal Clk that are applied from the signal interface part 110 and outputs the horizontal resolution signal HR including the information about the horizontal resolution to the dimming block adjusting part 150.

Referring to FIG. 4, the horizontal counter 142 resets a horizontal resolution stored therein when the horizontal synchronizing signal Hsync is applied, and counts the number of the clock signals Clk while the data enable signal DE is at a high level to obtain a horizontal resolution of the image.

The vertical counter 144 outputs a vertical resolution signal VR by using the horizontal synchronizing signal Hsync and the vertical synchronizing signal Vsync that are applied from the signal interface part 110, including information on a vertical resolution of the image to the dimming block adjusting part 150. Here, the vertical counter 144 may receive the data enable signal DE instead of the horizontal synchronizing signal Hsync as shown.

Referring to FIG. 5, the vertical counter 144 counts the number of the horizontal synchronizing signal Hsync during one frame to obtain the vertical resolution of the image. That is, the vertical counter 144 resets a vertical resolution stored therein when the vertical synchronizing signal Vsync is applied, and then counts the number of the horizontal synchronizing signal Hsync until a next vertical synchronizing signal Vsync is applied thereto to obtain a vertical resolution of the image.

The dimming block adjusting part 150 adjusts the size and the number of the dimming blocks 320 of FIG. 1 in response to the image resolution of the image obtained by the resolution analyzing part 140. That is, the dimming block adjusting part 150 obtains the size or the number of the dimming blocks 320 that is optimized to the image resolution in response to the horizontal resolution signal HR and the vertical resolution signal VR that are received from the resolution analyzing part 140, and then outputs a block size signal BS including information on the size of the dimming blocks 320 and a block number signal BN including information on the number of the dimming blocks 320 to the local dimming part 170.

The dimming block adjusting part 150 may output the block size signal BS and the block number signal BN. Alternatively, the dimming block adjusting part 150 may output only one of the block size signal BS and the block number signal BN. For example, the dimming block adjusting part 150 may output the block size signal BS when the number of dimming blocks 320 has been set.

The frame buffer 160 temporarily stores the image data Dat and the image control signal Con while the image resolution is obtained to adjust the size or the number of the dimming blocks 320 to output the image data Dat and the image control signal Con to the image signal output part 120 and the local dimming part 170.

For example, the frame buffer 160 receives the image data Dat, the clock signal Clk and the data enable signal DE from the signal interface part 110 to temporarily store the image data Dat, the clock signal Clk and the data enable signal DE. The frame buffer 160 may then output the image data Dat, the clock signal Clk and the data enable signal DE that are stored therein to the image signal output part 120 and the local dimming part 170 at the same time the dimming block adjusting part 150 outputs the block size signal BS and the block number signal BN. Here, the frame buffer 160 may store the image data Dat, the clock signal Clk and the data enable signal DE for one frame, and then may output the stored image data Dat, the stored clock signal Clk, and the stored data enable signal DE.

The local dimming part 170 receives the block size signal BS and the block number signal BN from the dimming block adjusting part 150, and receives the image data Dat and the image control signal Con from the frame buffer 160. The local dimming part 170 outputs the local dimming signal LDS for individually driving the dimming blocks 320 in response to the image data Dat, the block size signal BS, and the block number signal BN.

Hereinafter, size or number of the dimming blocks 320 that is optimized in accordance with an image resolution will be described.

Figure 6:
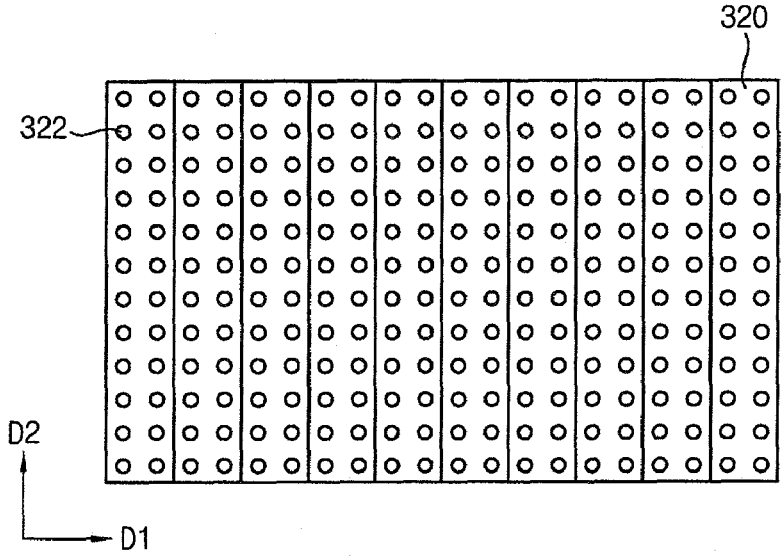
FIGS. 6 and 7 are plan views illustrating the dimming blocks of FIG. 1.
Figure 7:
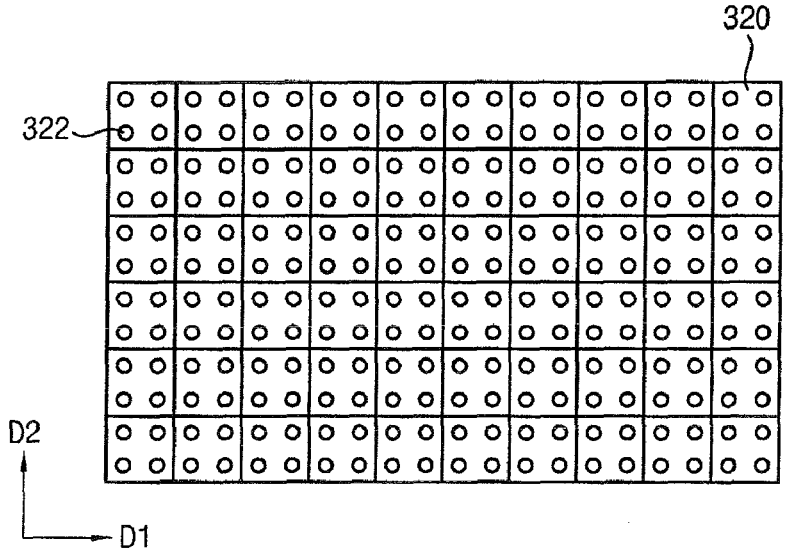

FIGS. 6 and 7 are plan views illustrating the dimming blocks of FIG. 1.

Referring to FIGS. 1, 6 and 7, the light source unit 300 may include a plurality of light-emitting diodes (LEDs) 322 which generate light. The LEDs 322 are arranged in a matrix shape along a first direction D1 that is shown as the horizontal direction and a second direction D2 that is shown as the vertical direction. Alternately, the LEDs 322 may include a plurality of red LEDs, a plurality of green LEDs and a plurality of blue LEDs. For another example, the LEDs 322 may include a plurality of white LEDs.

The LEDs 322 may be grouped into a plurality of dimming blocks 320 along the first direction D1 as shown in FIG. 6. Alternatively, the LEDs 322 may be grouped into a plurality of dimming blocks 320 along the first and second directions D1 and D2 as shown in FIG. 7. Thus, each of the dimming blocks 320 includes at least one of the LEDs 322.

In one example, ten dimming blocks 320 are arranged along the first direction D1 as shown in FIG. 6. In another example, sixty dimming blocks 320 are arranged in a matrix form along the first and second directions D1 and D2 as shown in FIG. 7.

In this embodiment, the number of dimming blocks 320 may be adjusted with the image resolution. For example, when the image resolution is increased, the number of dimming blocks 320 is increased.

Moreover, the number of dimming blocks 320 may be altered in accordance with the size of the display panel 220. For example, when the size of the display panel 220 is increased, the number of dimming blocks 320 may also increase.

The image resolution may be the pixel resolution of the display panel 220. Alternatively, the image resolution may be set by user. However, although the user sets the image resolution, the maximum image resolution is the pixel resolution of the display panel 220.

Figure 8:
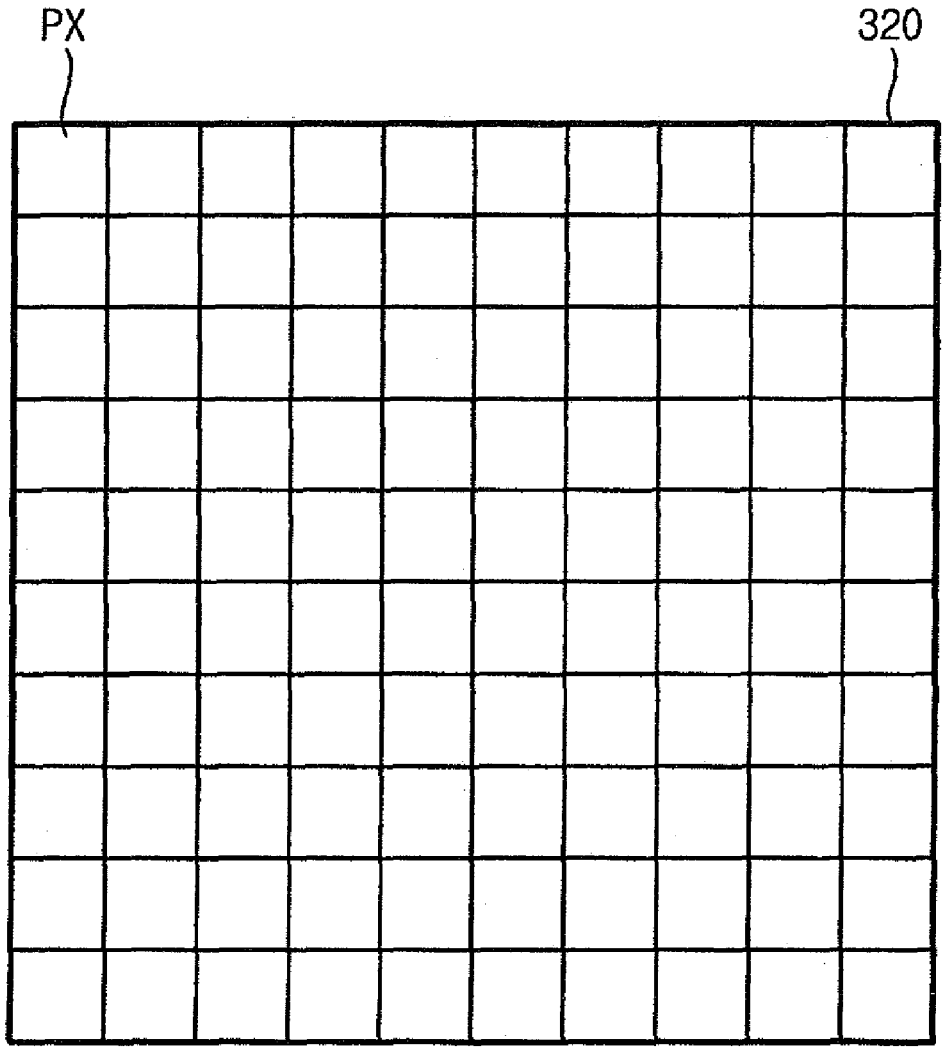
FIG. 8 is an plan view illustrating a plurality of pixels of the display panel corresponding to the dimming blocks of FIG. 7.

FIG. 8 is a plan view illustrating a plurality of pixels of the display panel corresponding to the dimming blocks of FIG. 7.

Referring to FIGS. 1, 7 and 8, each of the dimming blocks 320 corresponds to at least one of pixels PX of the display panel 220. For example, each of the dimming blocks 320 may correspond to the pixels PX that are arranged in a ten-column and ten-row matrix.

The size of the dimming blocks 320 corresponds to the number of pixel PX in each dimming block 320. That is, when the size of the dimming blocks 320 are increased, the number of the pixel PX in each of the dimming blocks 320 is increased.

In this embodiment, the size of the dimming blocks 320 may be adjusted according to the image resolution. For example, when the image resolution is increased, the size of the dimming blocks 320 is increased.

When the image resolution is fixed and the number of the dimming blocks 320 increases, the size of the dimming blocks 320 decreases. That is, when the image resolution is predetermined, the size of the dimming blocks 320 and the number of dimming blocks 320 are inversely proportional to each other.

Hereinafter, a light source driving method which drives a light source by generating a local dimming signal LDS will be described with reference to FIGS. 1 to 8.

An image signal including an image control signal Con and an image data Dat corresponding to an image resolution is generated in an external image board 10. Here, the image control signal Con contains image resolution information. The image resolution may be the pixel resolution of the display panel 220 of the display unit 200 or, the image resolution may be set by user.

Then, the image data Dat and the image control signal Con are applied from the image board 10, and the image resolution is obtained using the image control signal Con. The image control signal Con may include a clock signal (Clk) for synchronizing the image data Dat, a horizontal synchronizing signal (Hsync) for indicating a start or end of one line of the image data Dat, a vertical synchronizing signal (Vsync) for indicating a start or end of one frame of the image data Dat, and a data enable signal (DE) for indicating a valid interval of the image data Dat.

For example, while the data enable signal DE is at a high level, the number of the clock signals Clk is counted to obtain a horizontal resolution of the image. Then, the number of the horizontal synchronizing signal (Hsync) for one frame is counted to obtain a vertical resolution of the image.

Then, the size or the number of the dimming blocks 320 generating light in a local dimming method is adjusted in response to the image resolution, comprising a horizontal resolution and a vertical resolution. For example, when the image resolution is increased, the size or the number of the dimming blocks 320 is increased. Moreover, when the image resolution is fixed, the size of the dimming blocks 320 may be inversely proportional to the number of dimming blocks 320.

The local dimming logic board outputs a local dimming signal LDS for individually driving the dimming blocks 320 in response to the image data Dat and the size or the number of dimming blocks 320.

Then, light is generated from the light source unit 300 in response to the local dimming signal LDS.

According to the present embodiment, the image control signal Con outputted from the image board 10 is analyzed to obtain the image resolution, and then the size or the number of the dimming blocks is adjusted to be optimized to the obtained image resolution. Thus, regardless of the image resolution, a local dimming signal which corresponds to the size or the number of the dimming blocks optimized for that image resolution, may be generated.

EXAMPLE EMBODIMENT 2

Figure 9:
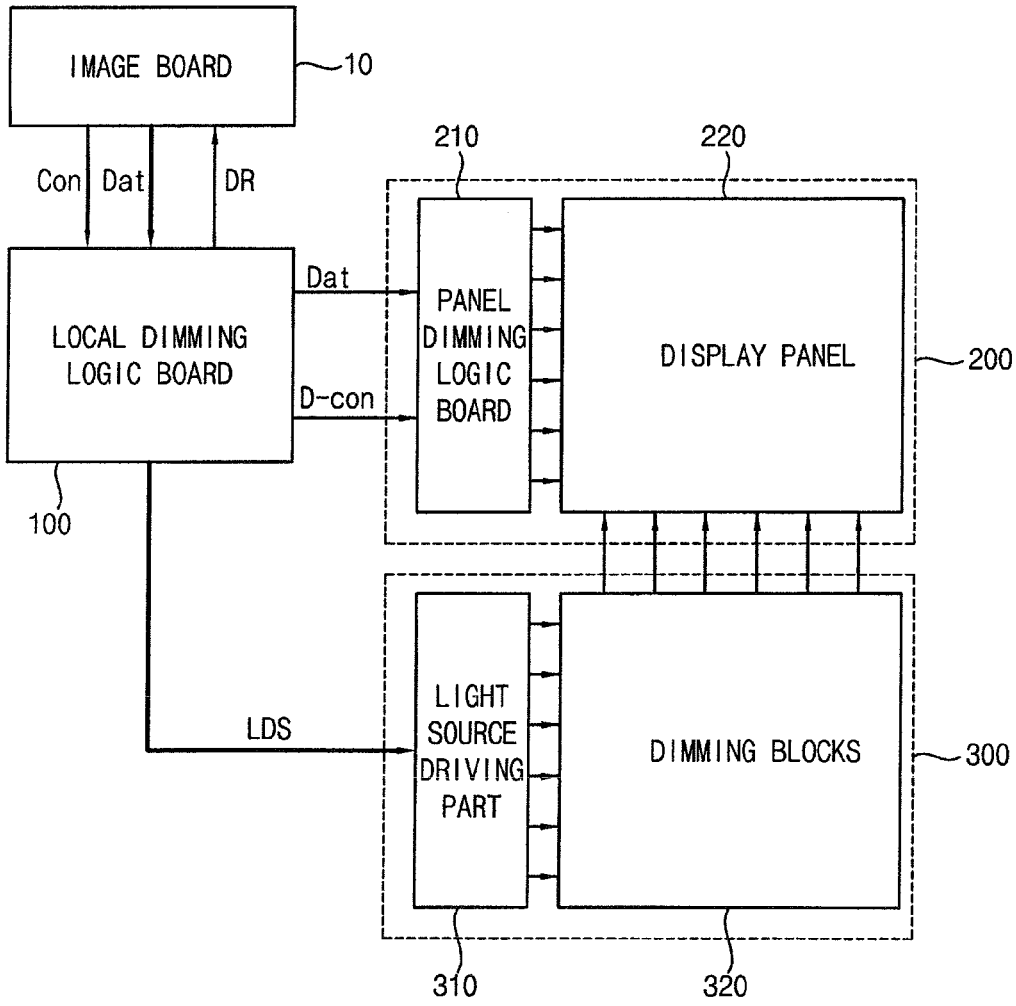
FIG. 9 is a block diagram schematically illustrating the display apparatus according to second exemplary embodiment of the present invention.
Figure 10:
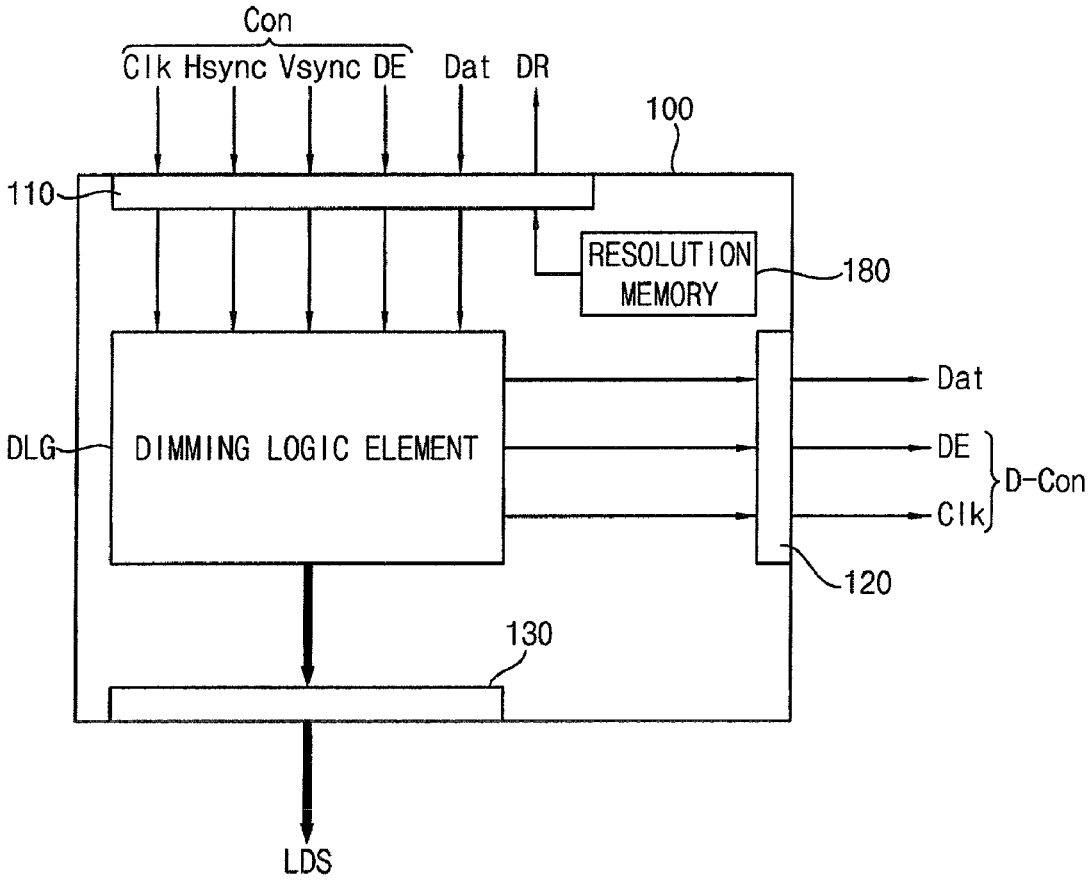
FIG. 10 is a block diagram illustrating a local dimming logic board of FIG. 9.

FIG. 9 is a block diagram schematically illustrating the display apparatus according to Embodiment 2 of the present invention. FIG. 10 is an enlarged block diagram illustrating a local dimming logic board 100 of FIG. 9.

The display device of the present embodiment is substantially the same as the display device of FIGS. 1 to 8 with a main difference being the presence of a resolution memory 180. Thus, identical reference numerals are used in FIGS. 9 and 10 to refer to components that are the same or like those shown in FIGS. 1 to 8, and a detailed description thereof is omitted.

Referring to FIGS. 9 and 10, a local dimming logic board 100 according to the present embodiment includes a resolution memory 180. The resolution memory 180 stores information on the pixel resolution of the display unit 300. For example, the pixel resolution may be 1440×900.

The resolution memory 180 outputs a resolution signal DR containing the pixel resolution. The signal interface part 110 changes the resolution signal DR into a signal at a level that is suitable for transmitting, and outputs the transformed pixel resolution signal to the image board 10.

The image board 10 may generate the image data Dat and the image control signal Con according to the resolution signal DR applied from the signal interface part 110, and may transmit the image data Dat and the image control signal Con to the signal interface part 110.

Hereinafter, a light source driving method which drives a light source by generating a local dimming signal LDS is described with reference to FIGS. 9 and 10.

First, the image board 10 receives information on the pixel resolution of the display unit 200 which is stored in the resolution memory 180 of the local dimming logic board 100.

The image board 10 generates an image signal including an image control signal Con and an image data Dat which corresponds to the pixel resolution.

The local dimming logic board 100 receives the image data Dat and the image control signal Con from the image board 10, and obtains an image resolution using the image control signal Con.

The local dimming logic board 100 adjusts the size and number of the dimming blocks 320 generating light in a local dimming method in response to the resolution of the obtained image data. That is, the local dimming logic board 100 determines the size or number of the dimming blocks 320 that is optimized for an image resolution.

The local dimming logic board 100 generates the local dimming signal LDS for individually driving the dimming blocks 320 in response to the image data Dat and the size and number of the adjusted dimming blocks 320.

The light source generates light in response to the local dimming signal LDS.

As described above, according to the present embodiment, the pixel resolution is obtained by using the image control signal Con generated according to a pixel resolution stored in the resolution memory, and then the size or the number of the dimming blocks is adjusted to be optimized in response to the obtained image resolution. Thus, regardless of the image resolution, a local dimming signal which corresponds to the size or the number of the dimming blocks optimized for that image resolution may be generated.

According to the present invention, the image control signal is analyzed to obtain the image resolution, and then the size or the number of the dimming blocks is adjusted to be optimized in response to the obtained image resolution. Thus, regardless of the image resolution, a local dimming signal which corresponds to the size or the number of the dimming blocks optimized for that resolution may be generated.

With the invention, the dimming logic element does not need to be replaced, even, although the image resolution varies. The invention allows the dimming logic element to be used as an universal device, and thus eliminates the costs associated with replacing the dimming logic element.

The foregoing is illustrative of the present invention and is not to be construed as limiting thereof. Although a few example embodiments of the present invention have been described, those skilled in the art will readily appreciate that many modifications are possible in the example embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific example embodiments disclosed, and that modifications to the disclosed example embodiments, as well as other example embodiments, are intended to be included within the scope of the appended claims. The present invention is defined by the following claims, with equivalents of the claims to be included therein.

What is claimed is:

1. A method of driving light sources, the method comprising:

obtaining an image resolution;

generating a block size signal and a block number signal from the image resolution, wherein the block size signal specifies a number of pixels in a dimming block and the block number signal specifies a number of dimming blocks;

generating a local dimming signal for individually driving each dimming block in response to an image data, the block size signal, and the block number signal; and driving a light source using the local dimming signal.

2. The method of claim 1, wherein the image resolution is obtained using an image control signal comprising a clock signal, a horizontal synchronizing signal, a vertical synchronizing signal, and a data enable signal.

3. The method of claim 2, wherein obtaining an image resolution comprises:

obtaining a horizontal image resolution by counting the number of cycles in the clock signal while the data enable signal is at a high level.

4. The method of claim 3, wherein obtaining an image resolution further comprises obtaining a vertical image resolution by counting the number of pulses in the horizontal synchronizing signal between two pulses of the vertical synchronizing signal.

5. The method of claim 1, further comprising generating an image control signal and the image data according to the image resolution stored in a resolution memory.

6. The method of claim 5, wherein the image resolution is a pixel resolution of a display unit for displaying an image.

7. The method of claim 1, further comprising generating an image control signal and the image data according to the image resolution set by a user.

8. A light source driving device comprising:

a resolution analyzing part for obtaining an image resolution;

a dimming block adjusting part for generating a block size signal and a block number signal from the image resolution, wherein the block size signal specifies a number of pixels in a dimming block and the block number signal specifies a number of dimming blocks;

a local dimming part generating a local dimming signal for individually driving each dimming block in response to an image data, the block size signal, and the block number signal; and a light source unit driven by the local dimming signal to generate light.

9. The light source driving device of claim 8, wherein the resolution is obtained by using an image control signal comprising a clock signal, a horizontal synchronizing signal, a vertical synchronizing signal, and a data enable signal.

10. The light source driving device of claim 9, wherein the resolution analyzing part comprises:

a horizontal counter for obtaining a horizontal image resolution by counting the number of signal cycles in the clock signal, while the data enable signal is at a high level; and a vertical counter for obtaining a vertical image resolution by counting the number of pulses in the horizontal synchronizing signal between two pulses of the vertical synchronizing signal.

11. The light source driving device of claim 8, further comprising a frame buffer for storing the image data and an image control signal while the image resolution is obtained to adjust the size or the number of the dimming blocks.

12. The light source driving device of claim 8, further comprising:

a signal interface part for receiving the image data and an image control signal from an external image board;

a dimming signal output part for outputting the local dimming signal to the light source unit; and an image signal output part for outputting the image data and the image control signal to a display unit for displaying an image.

13. The light source driving device of claim 12, wherein the image resolution is a pixel resolution of a display unit connected to the light source driving device.

14. The light source driving device of claim 13, further comprising a resolution memory storing the pixel resolution of the display unit.

15. The light source driving device of claim 14, wherein the signal interface part transmits the pixel resolution of the display unit stored in the resolution memory to the external image board.

16. A display apparatus comprising:

a display unit comprising a display panel for displaying an image and a panel driving part for driving the display panel;

a light source unit comprising a plurality of dimming blocks to provide the display unit with light and a light source driving part individually controlling the dimming blocks;

a local dimming driving part controlling the panel driving part and the light source part in response to an image data and an image control signal that are applied from an external source, the local dimming driving part comprising a resolution analyzing part for obtaining an image resolution using the image control signal, a dimming block adjusting part for generating a block size signal and a block number signal from the image resolution, wherein the block size signal specifies a number of pixels in a dimming block and the block number signal specifies a number of dimming blocks; and a local dimming part generating a local dimming signal for individually driving each dimming block in response to an image data, the block size signal, and the block number signal.

17. The display apparatus of claim 16, wherein each of the dimming blocks comprises at least one light-emitting diode.

18. The display apparatus of claim 16, wherein the image resolution is a pixel resolution of the display panel, and the local dimming driving part further comprises a resolution memory for storing the pixel resolution of the display panel.

19. The display apparatus of claim 16, wherein the local dimming driving part further comprises a frame buffer to store the image data and the image control signal while the image resolution is obtained.

* * * * *